US007476052B2

(12) United States Patent
Hall

(10) Patent No.: US 7,476,052 B2
(45) Date of Patent: Jan. 13, 2009

(54) RETRACTABLE FLUID-FILLED SPEED BUMP/VEHICLE RESTRICTOR

(76) Inventor: Brett Osmund Hall, 4206 Lazy Creek Dr., Marietta, GA (US) 30066

( * ) Notice: Subject to any disclaimer, the term of this patent is extended or adjusted under 35 U.S.C. 154(b) by 0 days.

(21) Appl. No.: 10/247,858

(22) Filed: Sep. 20, 2002

(65) Prior Publication Data

US 2003/0053860 A1 Mar. 20, 2003

Related U.S. Application Data

(60) Provisional application No. 60/323,553, filed on Sep. 20, 2001.

(51) Int. Cl.
*E01F 13/00* (2006.01)

(52) U.S. Cl. ..... 404/15

(58) Field of Classification Search ..... 404/6, 404/15, 16, 11, 10

See application file for complete search history.

(56) References Cited

U.S. PATENT DOCUMENTS

| | | | | | |
|---|---|---|---|---|---|
| 3,389,677 | A | | 6/1968 | Dunne | |
| 3,720,181 | A | * | 3/1973 | Elkins | 116/63 P |
| 4,203,685 | A | * | 5/1980 | Sanchez | 404/6 |
| 4,342,525 | A | * | 8/1982 | Mastronuzzi, Jr. | 404/6 |
| 4,362,424 | A | * | 12/1982 | Barber | 404/6 |
| 4,367,975 | A | * | 1/1983 | Tyers | 404/6 |
| 4,490,068 | A | * | 12/1984 | Dickinson | 404/6 |
| 5,267,808 | A | * | 12/1993 | Welford | 404/11 |
| 5,509,753 | A | | 4/1996 | Thompson | |
| 6,010,277 | A | * | 1/2000 | Follman | 404/11 |
| 6,024,510 | A | * | 2/2000 | Kamienchick | 404/15 |
| 6,223,125 | B1 | * | 4/2001 | Hall | 701/301 |
| 6,623,206 | B1 | * | 9/2003 | Blair et al. | 404/16 |
| 6,659,682 | B2 | * | 12/2003 | Heeks | 404/15 |
| 6,726,399 | B2 | * | 4/2004 | Heeks et al. | 404/15 |
| 7,011,470 | B1 | * | 3/2006 | Breazeale et al. | 404/11 |

FOREIGN PATENT DOCUMENTS

| | | | | |
|---|---|---|---|---|
| EP | 370154 | A1 | * | 11/1988 |
| GB | 2030197 | A | * | 4/1980 |
| GB | 2 266 552 | | * | 11/1993 |
| GB | 2288419 | A | * | 10/1995 |
| GB | 2328235 | A | * | 2/1999 |
| GB | 2333114 | A | | 7/1999 |
| WO | WO 9840563 | A1 | * | 9/1998 |

* cited by examiner

*Primary Examiner*—Gary S Hartmann

(57) ABSTRACT

Primary vehicle impedance is provided when an actuator exerts a rigid object against a envelope of enclosed fluid to activate the restriction surface by pushing the fluid from the reservoir to the supporting side of the restriction surface. Reversal of the actuator withdraws the rigid object from the enclosed fluid volume, allowing the fluid to return from supporting the deployed restriction surface back to the reservoir. Secondary vehicle impedance is provided when the vehicle's tires traverse a predetermined contoured shape of the restriction surface. Continuous contact between the radial tire surface and the ends of the restriction surface is maintained by tapering the ends. Static structural components support the fluid and distribute the forces to the ground as the impact and weight of the vehicle's tires are applied to the restriction surface.

14 Claims, 3 Drawing Sheets street surface
debris
1 fluid
Controller
12
Traffic Management Command
Traffic Management Control Signal
1a
1b
2
3
4
5
6
7
8
8a
9
10
11

RETRACTABLE FLUID-FILLED SPEED BUMP/VEHICLE RESTRICTOR

CROSS REFERENCE TO RELATED APPLICATIONS

This application claims the benefit of U.S. Provisional Patent Application Ser. No. 60/323,553 filed Sep. 20, 2001.

BACKGROUND OF THE INVENTION

This document describes the conceptual design of a Vehicle Restrictor, a device intended to restrict the position and speed of automotive vehicles. This concept is associated with the Collision Avoidance System (U.S. Pat. No. 6,223,125 B1), in which one or more Vehicle Restrictors are system components.

BRIEF SUMMARY OF THE INVENTION

A Vehicle Restrictor provides the same function as a traditional speed bump but is capable of variable height activation relative to the surface of the road. Consequently the motorist will receive a tactile feedback through the vehicle's tires and suspension system that varies from a maximum restriction to no restriction. Thus a Vehicle Restrictor can be used in a traffic environment in which it is impractical to use a traditional speed bump. When integrated with an appropriate traffic management system, the Vehicle Restrictor can be used to impede the position and speed of vehicles for improved traffic management and the prevention of vehicular collisions involving pedestrians, trains, and other vehicles. Such a tactile feedback serves to both remind the operator of the traffic laws as well as to provide restraint from doing otherwise. The activation of a Vehicle Restrictor can also improve motorist reaction time by providing forewarning of an otherwise imminent collision. The present invention provides a more flexible degree of impedance control and a design requiring less maintenance than other related retractable devices.

PRIOR ART

Figures 1A, 1B, 1C, 1D:
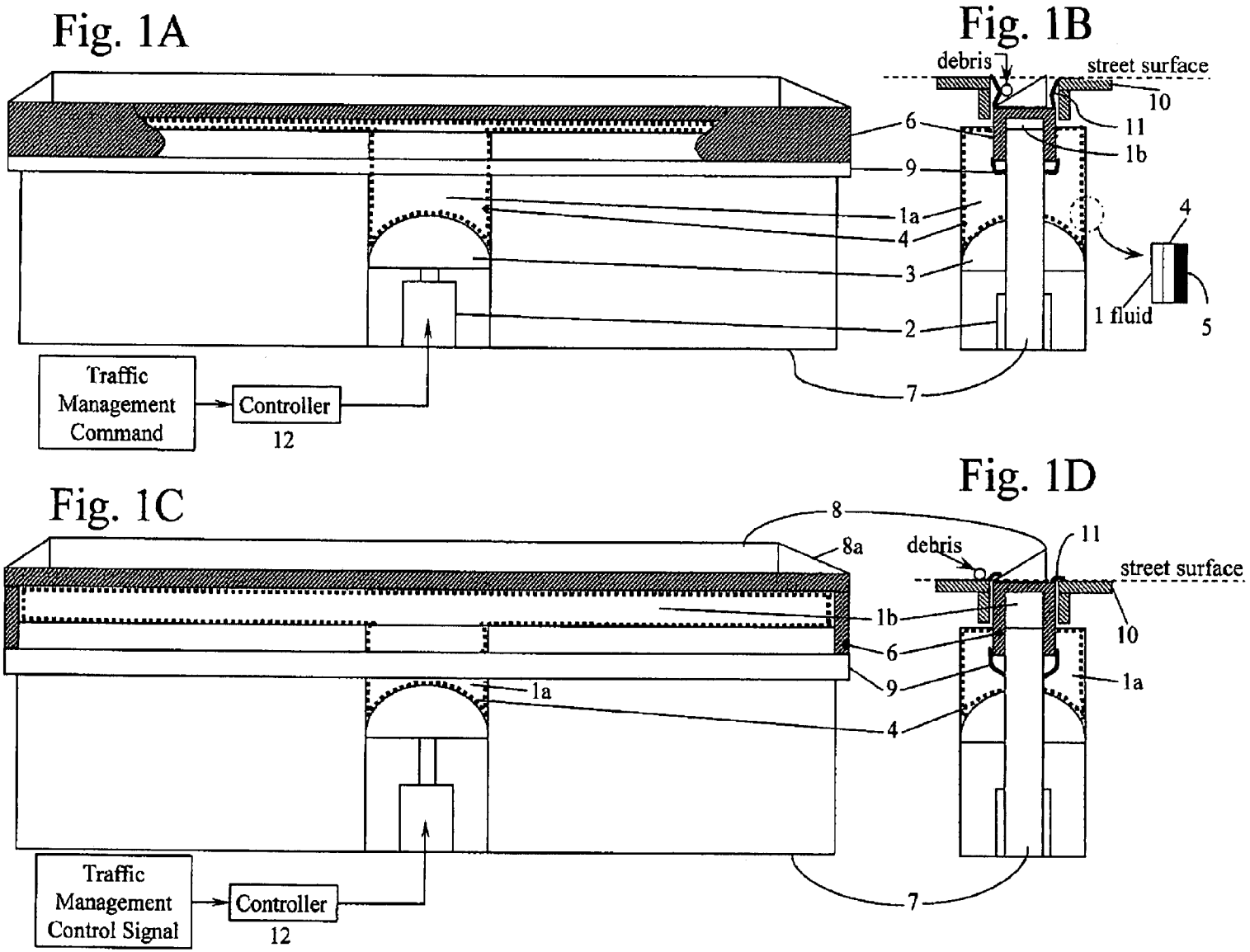
FIG. 1A is a front cross-sectional view of the inactive Vehicle Restrictor, showing, a partial sectional of the front-side of the Cap 6.
FIG. 1B is a side cross-sectional view of the inactive Vehicle Restrictor
FIG. 1C is a front cross-sectional view of the active Vehicle Restrictor
FIG. 1D is a side cross-sectional view of the active Vehicle Restrictor

Related inventions are by Dunne U.S. Pat. No. 3,389,677, Thompson U.S. Pat. No. 5,509,753, and Harvey GB 2333114

A. Prior art relies significantly on bearing, levers, rollers, and other such components. This is particularly an issue since the components will be located below the street surface, making maintenance difficult. So what is needed is a system that uses fewer of the components that are subject to mechanical wearing. The redistribution of stresses to lessen the forces on the existing components will also provide longer operating life. These expected advantages are obtainable because the present invention uses fluid to actuate a surface for impeding the vehicle and transmit the impact of the vehicle's weight forces to the ground.

SUMMARY OF THE INVENTION

The Vehicle Restrictor is generally positioned transverse to the roadway. It is installed in a recessed region below the road surface. The objective is to provide a Vehicle Restrictor design that is simple, requires less maintenance due to the fewer mechanical components and the redistribution of forces from movable mechanical components to static structural components. It is also desirable to provide vehicle impedance that is variable in the degree of operation. This provides the motorist with better interactivity and feedback regarding the urgency of the traffic environment. For example, an otherwise impending collision involving the vehicle to be impeded would require faster activation of the Vehicle Restrictor to capture the driver's attention to invoke more aggressive slowing of the vehicle.

The present invention is intended to be responsive to the commands from a traffic management system that monitors a traffic environment such as the Collision Avoidance System (U.S. Pat. No. 6,223,125 B1). Upon receiving commands from such a traffic management system the system employs the following operation.

The primary embodiment is shown in FIGS. 1A-1D. System operation focuses on the transfer of fluid between a reservoir volume 1*a* and an active volume 1*b*. An insufficient amount of fluid in the active volume 1*b* corresponds to a system that is inactive in providing vehicle impedance. In the primary embodiment the fluid is transferred to the active volume 1*b* by decreasing the dimensions of the reservoir volume 1*a*, basically squeezing the fluid. An Actuator 2 presses a rigid object (Plunger 3) against a leak-resistant membrane (Bladder 4) containing the fluid 1. Bladder Reinforcement 5 is provided to the Bladder 4 throughout the system to prevent its bulging as the fluid 1 is pressurized and transferred. The system transfers fluid 1 from a reservoir volume 1*a* into an active volume 1*b* bounded on the top by the Cap 6 and on the bottom by the Support Frame 7. The bottom of Support Frame 7 is held static against the ground but the Cap 6 is elevated as fluid 1 is transferred into the active volume 1*b* to position the attached Restriction Surface 8 above street level and create impedance to the movement of vehicles. Varying the height of activation is accomplished by varying the volume of fluid 1 transferred from the reservoir volume 1*a* to the active volume 1*b*.

Maintaining fluid 1 in the active volume 1*b* to support the Restriction Surface 8 during vehicle loading distributes the loading more uniformly than with a system that has discrete mechanical loading points. The uniform support keeps the load balanced to prevent the shifting of components, uneven mechanical wear, and reduced component life. As the vehicle makes contact with the Restriction Surface 8, the topside of the attached Cap 6 pressurizes the fluid 1 because of the vehicle's weight. That fluid pressure is distributed to the inner surfaces of the Cap 6 as well as the top of the Support Frame 7. The Support Frame 7 transfers some of the forces to the ground. The overall result is that the forces resulting from the vehicle's weight are distributed primarily to structural components rather than to moving components that are subject to wear (mechanical pins, gears, levers, rollers, etc).

As the Actuator 2 withdraws the Plunger 3, the reservoir volume 1*a* increases and allows the fluid 1 in the active volume 1*b* to return to the reservoir volume 1*a*. This allows the elevation of the Cap 6 and the attached Restriction Surface 8 to return below the street surface level, thus removing vehicle impedance.

The Actuator 2 provides the extension and retraction of the Plunger 3 according to the commands from the Controller 12. The Actuator 2 is of well-known technology such as a hydraulic cylinder, pneumatic cylinder, or motorized jackscrew. The technology is not particular provided that it can provide the controlled force to transfer the fluid 1 into the active volume 1*b*. The motorized jackscrew is the preferred component because of maintenance and energy consumption advantages. The motorized jackscrew requires fewer components and will require less maintenance than the hydraulic or pneumatic systems. This is especially an issue considering the system will be stored below the street level and frequent maintenance would be too disruptive to traffic. After the motorized jackscrew is positioned during a particular actuation it will hold its position without expending additional energy. This allows the volume of fluid 1 displaced by the Plunger 3 to be maintained as the vehicle's weight is applied to the Restriction Surface 8.

A variation of the primary embodiment is to relocate the Actuator 2, Plunger 3 and initial part of the reservoir off to the side of the street for easier accessibility. Although this variation will require a longer conduit between the reservoir and the active volume (still located below the street surface), the Actuator 2 would be more accessible for maintenance.

An alternate embodiment to transfer fluid 1 between the reservoir volume 1*a* and the active volume 1*b* is to use pumping systems, which are of commonly known technology. The Actuator 2 and Plunger 3 are part of the preferred embodiment because less maintenance is required.

The Plunger 3 is part of the fluid transfer system in the primary embodiment and is used in conjunction with the Actuator 2 to reduce the reservoir volume 1*a*. A rigid material is most desirable because of the compressive forces required for squeezing the fluid 1. A specific shape for the Plunger 3 is not required, However a spherical surface is more efficient because a sphere provides a large surface area for its geometry. Thus the amount of fluid 1 that can be displaced for a given movement of the Plunger 3 is greater with a spherical shape.

The proposed invention relies on the placement of fluid 1 to actuate the system and to transmit the vehicle's impact and weight-bearing forces. In general a fluid would be a substance (liquid, gas, gel, etc.) capable of flowing or conforming to the outline of its container. It is preferred that the fluid 1 be incompressible so that the desired positioning of the Restriction Surface 8 above the street surface is not reduced by fluid compression.

Except for one or more ports for the entry and exit of fluid 1, the Bladder 4 will be enclosed to constrain the fluid 1. This flexible, leak-resistant membrane is employed within and between the reservoir volume 1*a* and the active volume 1*b*, the walls of which (Bladder Reinforcement 5) will protect the Bladder 4 from puncture, abrasion, and bulging. In an alternate embodiment friction seals similar to piston rings could be used instead of a Bladder 4 to contain the fluid 1 between moving parts in the reservoir volume 1*a* and the active volume 1*b*. However, the Bladder 4 is preferred because of better reliability against fluid leakage and less friction wear.

The Cap 6 encloses the fluid 1 between its inner surfaces and the top of Support Frame 7 to comprise the active volume 1*b*. Its displacement from the Support Frame 7 depends on the amount of fluid 1 in the active volume 1*b*. Its top outer surface supports the Restriction Surface 8. Another embodiment of the same invention would make the Cap 6 and the Restriction Surface 8 the same physical part. The inside lateral surfaces of the Cap 6 can be used to support the lateral fluid 1 pressure within the active volume 1*b*.

The top of the Support Frame 7 fits within the open side of the Cap 6, to support the underside of the contained fluid 1 within the active volume 1*b* as shown in FIGS. 1A-1D. When the fluid pressure increases due to the impact and loading forces from the vehicle, the Support Frame 7 transmits the forces to the ground through its axial support along its length.

To reduce maintenance, actuation components could be sealed from contaminants resulting from exposure to the traffic environment and the weather. A seal placed between components that are intended to move relative to each other should be flexible as well as reduce the entry of dirt, gravel, and moisture. A Cap Seal 9 could be placed between the perimeters of the Cap 6 and the Support Frame 7 as shown in FIGS. 1A-1D. FIGS. 1C-1D shows how the flexibility of the Cap Seal 9 will still allow the Cap 6 and the Support Frame 7 to move relative to each during system activation, while keeping contaminants out of the opening between the two.

The Bladder Reinforcement 5 in the Plunger 3 area could be extended to provide an enclosed seal for the Actuator 2. An example of this is a channeled box or cylinder enclosing the Actuator 2/Plunger 3 or other fluid transfer means.

Figure 3:
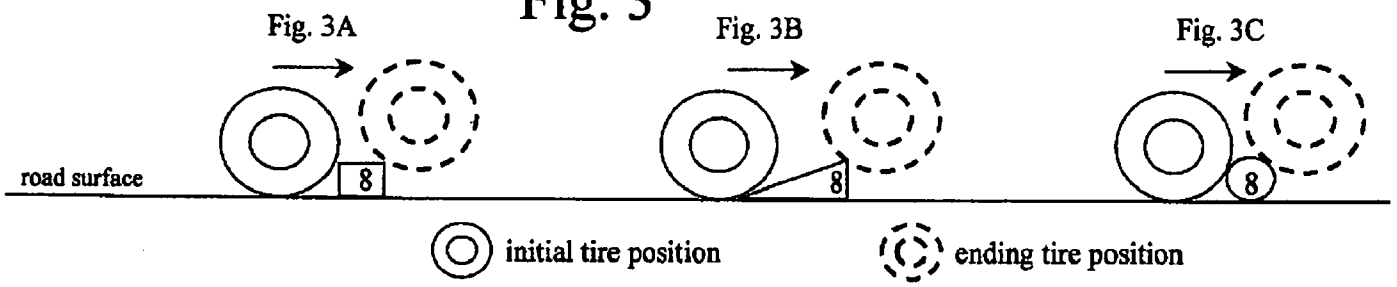

The Restriction Surface 8 is mounted on top to the Cap 6 and is the component of the Vehicle Restrictor that makes contact with the vehicle's tires. Its shape is expected to have an effect on the nature of the impact to the vehicle's suspension system. Consider the following examples. Both the initial and ending tire positions shown in FIG. 3A will provide impact to the vehicle. The leading edge of the Restriction Surface 8 provides a first impact as the tire makes contact. The falling edge allows the tire to directly strike the road surface, thus providing a second impact. In FIG. 3B the initial impact is lessened at the initial position with the absence of an abrupt surface change as the tire traverses the surface. However, the falling edge allows the vehicle to directly strike the road surface, providing the most significant impact for this particular shape. In FIG. 3C, the initial impact is similar to that in FIG. 3A but is lessened on the falling edge because of the presence of surface material to lower the position of the tire before it strikes the road surface. Various combinations of shapes for the leading and falling edges can be combined to obtain the desired total impact effect.

Figure 2A:
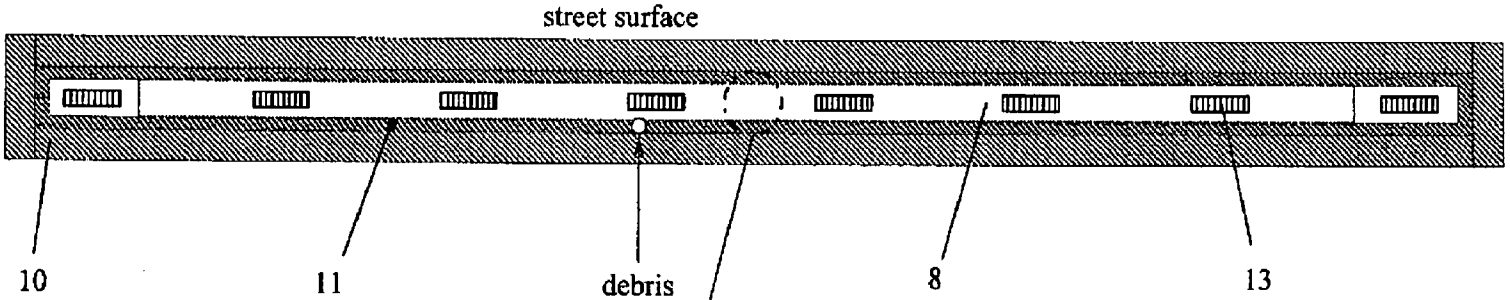
FIG. 2A shows an overhead view of the Vehicle Restrictor opening at the street surface
Figure 2B:
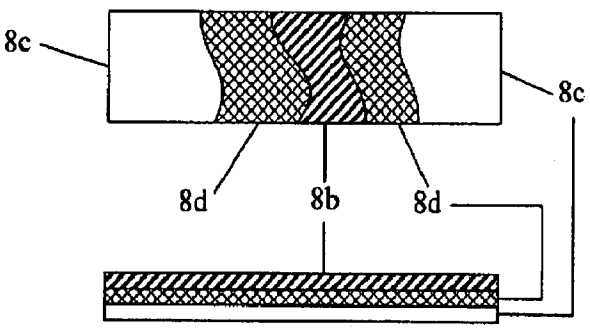
FIG. 2B shows the layers of the Restrictor Surface in the primary embodiment FIG. 3 are examples of how various Restriction Surface 8 shapes vary the type of vehicle impedance

As shown in FIG. 2B, in the primary embodiment the Restriction Surface 8 is a combination of components providing the basic surface shape, the Wear Indicator 8*d*, and the Wear Covering 8*c*. The Wear Indicator 8*d* and Wear Covering 8*c* address maintenance issues due to abrasion from the tires. Another embodiment of the invention may not address such maintenance issues and simply provide a component for making contact with the tires to offer impedance.

FIG. 2B shows that the Wear Covering 8*c* fits on or over the Restriction Surface Shape 8*b* to make contact with the vehicle's tires. The abrasion from the tires eventually causes the Wear Covering 8*c* to require replacement. The use of a replaceable Wear Covering 8*c* over the Restriction Surface Shape 8*b* allows rapid and inexpensive maintenance without degradation of the Restriction Surface Shape 8*b*. The Wear Covering 8*c* material should be abrasion resistant without being unduly harsh on the wearing of tires.

The Wear Indicator 8*d* reveals when the Wear Covering 8*c* is due for replacement. An example of a Wear Indicator 8*d* is a colored layer beneath the Wear Covering 8*c* surface that becomes exposed and visible only after erosion has occurred through the Wear Covering 8*c*. At that time the Wear Covering 8*c* is due for replacement.

Contact between the Restriction Surface 8 and the tire should be predominantly confined to the tire's outer rim surface, the portion that contacts the road. Contact with the sides of tire should be minimized. To accomplish these constraints the ends of the Restriction Surface 8 may require a different cross-section than the middle portions.

Figure 4:
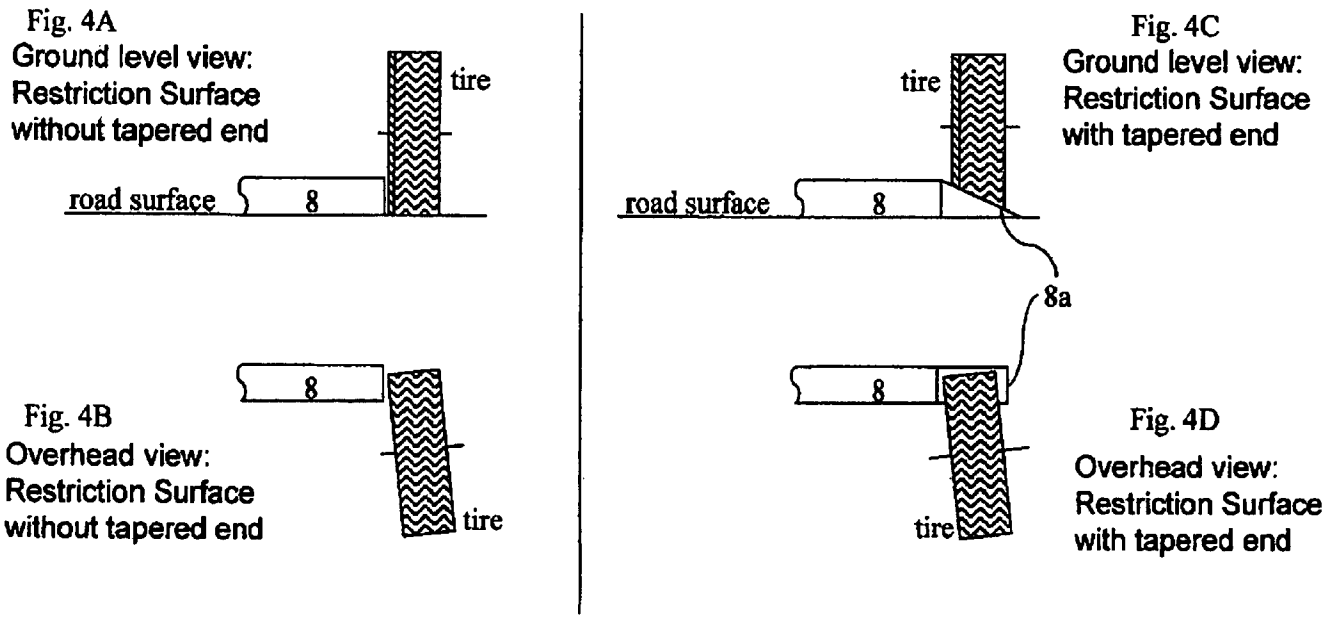
FIG. 4A and 4B shows ground level and overhead views of Restriction Surfaces 8 without tapered ends to demonstrate the comparative affect on the tire and steering.
FIG. 4C and 4D shows ground level and overhead views of Restriction Surfaces 8 with tapered ends to demonstrate the comparative affect on the tire and steering.

FIG. 4A shows the ground level view and FIG. 4B shows the overhead view of the tire as it passes the right end of the Restriction Surface 8 without a tapered end. FIG. 4B implies that if the inside of the tire wall makes significant contact with the abrupt outer edge of the Restriction Surface 8 with a significant deployment height during a slight angle of the tire, then disruption to the steering of the vehicle may result. This is not the same type of disruption to vehicle movement that results from maintaining contact with the tire's outer rim surface and elevating the tire to invoke the suspension system as show in FIGS. 3A through 3C. The vehicle restriction means described in this invention seeks the latter approach by also using the concept of tapered ends as shown in the ground level view of FIG. 4C and the overhead view of FIG. 4D. These views show that as the tire approaches the end of the Restriction Surface 8 at the same angle as before, contact is maintained with the tire's outer rim surface, thus preventing the previously described possible disruption to steering. The contour of the tapered end can be made moderate enough to maintain sufficient contact with the outer rim surface of the tire.

FIG. 2A shows that Warning Indicators 13 (the illumination of lights or reflective or colorful markings) placed in proximity to the Vehicle Restrictor opening at the street level will capture the motorist's attention and warn of system activation or presence. Such a warning system may place the Warning Indicators 13 on the Restriction Surface 8, to be visible as the surface is active. Warning Indicators 13 may also be placed on the street surface such as on or around Street Frame 11. The idea is to notify the motorist in advance of reaching the Vehicle Restrictor so that sufficient time is given to slowing the vehicle down.

The Street Frame 10 In FIG. 1B 1D, and 2A maintains a defined opening for raising and lowering of the Restriction Surface 8 and the Cap 6 (not shown but positioned below the Restriction Surface 8. Otherwise, erosion of the road materials might interfere with system operation or continually degrade the integrity of the road surface surrounding the opening. A material such as angled steel may serve as an adequate Street Frame 10.

The Street Frame Seal 11 shown in FIGS. 2A, 1B and 1D is installed between the top of the cap and the Street Frame 10. It is installed around the street surface opening to reduce debris from entering the recessed area where the system is installed. Since it is the first line of defense against contaminants it should not only be flexible but also be toughen against puncturing or abrasion. FIG. lB and 1D shows how the seal Street Frame Seal 11 will reduce the presence of debris from contaminating the system.

The Controller 12 will convert command signals from an external traffic management system to the appropriate vehicle impedance. The activation and deactivation response times of the Vehicle Restrictor may need to be varied depending on the speed and or distance of a particular vehicle to be restricted. The degree of the motorists' compliance with the traffic laws and safety intent within an environment using vehicle restriction may place a greater or lesser demand on the Vehicle Restrictor. Thus for the most enhanced operation, the Controller 12 should be capable of providing proportional deployment height and variable speed responses of the Restriction Surface 8 relative to the traffic management system's command signals. This can be accomplished with servo controller or similar well-known technology to compare and or adjust the movement of the actuation components relative to the command from the traffic management system.

An alternate embodiment of this invention is to configure the actuation components so that a restriction surface below the road surface is presented to the vehicle's tire. This negative activation (as opposed to the positive activation previously described) would resemble a recessed area across a lane of traffic with a retractable door or surface that varies the depth that the tire drops below the road surface. In an inactive position, the restriction surface is generally level with the road surface, as supported by a fluid-filled volume. However, upon activation the physical support of the top surface would be lessened by extracting fluid from the supporting fluid-filled volume to allow the surface to convex and present a certain cavity depth to the tire, much like a controllable depth pot-hole.

It is to be understood that the present invention is not limited to any of the embodiment described above, but encompasses any and all embodiments within the scope of the following claims.

What I claim as my invention is:

1. A vehicle restrictor system for the impedance and control of vehicle movement, said system comprising:

a restriction surface to propose an impact to the vehicle's suspension system resulting from the contact between said restriction surface and the vehicle's tires;

an arrangement comprising a volume of fluid sustaining said restriction surface, and a flexible fluid reservoir in communication with said volume of fluid, said flexible fluid reservoir having a region for pressing, and an object for pressing, positioned proximate to said region for pressing, and a bidirectional actuator, operative to bidirectionally actuate said object for pressing.

2. The system according to claim 1, further comprising one or more structural members to confine said volume of fluid and said flexible fluid reservoir.

3. The system according to claim 1, further comprising a controller to govern the rate and amount of fluid sustaining said restriction surface whereby the height and activation speed of the restriction surface is controlled.

4. The system according to claim 1, wherein forces resulting from the vehicle's contact with said restriction surface are transmitted by said volume of fluid sustaining said restriction surface to one or more support components.

5. The system according to claim 1, wherein some portion of said restriction surface is tapered to maintain predominant contact with the outer rim surface of the tire.

6. The system according to claim 1, wherein said restriction surface has a predetermined shape to invoke a specific type of vehicle impedance.

7. The system according to claim 1, further comprising a covering surface dimensioned to fit over or on said restriction surface to provide resistance to wear or modular maintenance.

8. The system according to claim 7, further comprising a means for indicating the extent of wear associated with said covering.

9. The system according to claim 1, further comprising at least one seal carried in close proximity to system components to provide resistance to the penetration of contaminants.

10. The system according to claim 1, further comprising illuminative indications of the vehicle restrictor's presence or operation.

11. The system according to claim 1, wherein height of said restriction surface is measured positively or negatively from the ground surface on which the vehicle's tires travel.

12. The system according to claim 1, wherein said arrangement instead comprises a volume of fluid substantially sustaining said restriction surface, a fluid reservoir in communication with said volume of fluid, said fluid reservoir having a fluid inlet, and a pump.

13. A vehicle restrictor system for the impedance end control of vehicle movement, said system comprising:

a surface to provide an impact to the vehicle's suspension system resulting from the contact between said surface and the vehicle's fires, said surface having an upper portion, a lower portion and a length;

a first volume of fluid underlying said lower portion of said surface end extending approximately said length of said surface such as to provide a distributed support for said surface at a degree of height, wherein said first volume of fluid sets and generally maintains said surface a degree of height impedance through said distributed support;

a second volume of fluid in communication with said first volume of fluid, wherein said second volume of fluid acts sea reservoir to said first volume of fluid;

a fluid transfer means by which the setting of a degree of height impedance of said surface by said first volume of fluid can be varied through fluid transfer with said second volume of fluid said fluid transfer means comprising at least one plunger positioned approximate to said second volume of fluid and an actuator for pressing said at least one plunger.

14. A method for impeding and controlling vehicle movement comprising:

a) bi-directionally actuating an object for pressing positioned proximate to a flexible reservoir volume;

b) varying the amount of fluid between said flexible reservoir volume and volume sustaining a restriction surface and c) setting amount of fluid within said volume sustaining said restriction surface to produce a height of said restriction surface.

* * * * *